US006453691B1

(12) United States Patent
Seo et al.

(10) Patent No.: US 6,453,691 B1
(45) Date of Patent: Sep. 24, 2002

(54) AIR CONDITIONER WITH A PRESSURE REGULATION DEVICE AND METHOD FOR CONTROLLING THE SAME

(75) Inventors: Hyeong-Joon Seo, Suwon (KR); Jong-Moon Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/816,222

(22) Filed: Mar. 26, 2001

(30) Foreign Application Priority Data

Dec. 18, 2000 (KR) ..... 00-77926

(51) Int. Cl.[7] ..... F25B 1/00; F25B 49/00; F25B 41/00

(52) U.S. Cl. ..... 62/228.5; 62/228.3; 62/196.3

(58) Field of Search ..... 62/196.3, 228.3, 62/228.1, 228.5, 196.1

(56) References Cited

U.S. PATENT DOCUMENTS 4,326,387 A * 4/1982 Friedman ..... 62/184
4,418,548 A * 12/1983 Sawyer ..... 62/175
4,787,211 A * 11/1988 Shaw ..... 62/117
5,062,274 A * 11/1991 Shaw ..... 62/117
5,570,585 A * 11/1996 Vaynberg ..... 62/175
5,735,135 A * 4/1998 Katsuki et al. ..... 62/259.1
6,085,533 A * 7/2000 Kaido et al. ..... 62/196.2

FOREIGN PATENT DOCUMENTS

JP 07-071853 3/1995
JP 09-152197 6/1997

* cited by examiner

*Primary Examiner*—William C. Doerrler
(74) *Attorney, Agent, or Firm*—Robert E. Bushnell, Esq.

(57) ABSTRACT

Disclosed herewith is an air conditioner with a pressure regulation device. The air conditioner controls the number of operated compressors according to load. The air conditioner includes a plurality of bypass conduits for guiding gaseous refrigerant from the outlet sides of compressors to the inlet sides of the compressors. A plurality of bypass valves are arranged on the bypass conduits for selectively opening and shutting the bypass conduits. A control unit controls the opening and closing of the bypass valves so as to control pressure in the inlet sides of one or more started compressors during the starting of the compressors. In addition, a method for controlling the air conditioner is disclosed.

10 Claims, 5 Drawing Sheets

AIR CONDITIONER WITH A PRESSURE REGULATION DEVICE AND METHOD FOR CONTROLLING THE SAME

CLAIM OF PRIORITY

This application makes reference to, incorporates the same herein, and claims all benefits accruing under 35 U.S.C. §119 from my application entitled AIR CONDITIONER HAVING PRESSURE CONTROLLING UNIT AND ITS CONTROL METHOD filed with the Korean Industrial Property Office on Dec. 18, 2000 and there duly assigned Ser. No. 2000-77926.

BACKGROUND OF THE INVENTION

1. Field of the Invention

The present invention relates generally to air conditioner, and more particularly to an air conditioner with a pressure regulation device and method for controlling the same.

2. Description of the Prior Art

An air conditioner generates cool air using a refrigeration cycle, and supplies it into a room.

The refrigeration cycle employed in the air conditioner is comprised of a compressor, a condenser, a capillary tube and an evaporator. Gaseous refrigerant sucked into the compressor is compressed into high-temperature, high-pressure gaseous refrigerant by the operation of a motor within the compressor. The compressed gaseous refrigerant discharged from the compressor is condensed (liquefied) to high-pressure liquid refrigerant by heat exchange with outdoor air supplied by a condenser fan. The condensed refrigerant in the condenser is expanded while passing through the capillary tube. The expended refrigerant is evaporated by heat exchange with indoor air, by which process the refrigerant absorbs heat from the surroundings.

FIG. 1 is a schematic diagram showing the construction of the outdoor unit of a conventional air conditioner.

Referring to drawing, the conventional outdoor unit includes a first compressor 1*a* and a second compressor 1*b* that are operated at constant-speeds and connected in parallel. In order to separate oil from refrigerant discharged from the compressors 1*a* and 1*b*, a first oil separator 2*a* is connected to the outlet side of the first compressor 1*a* and a second oil separator 2*b* is connected to the outlet side of the second compressor 1*b*. The outlet sides of the first and second oil separators 2*a* and 2*b* are merged together and then connected to first and second condensers 6*a* and 6*b* through a four-way valve 5. The first and second condensers 6*a* and 6*b* are connected to an indoor unit (not shown) through a liquid receiver 8. A first condenser fan 7*a* is situated in the vicinity of the first condenser 6*a* and a second condenser fan 7*b* is situated in the vicinity of the second condenser 6*b*. The refrigerant-return side of the indoor unit is connected to the inlet sides of the first and second compressors 1*a* and 1*b* through an accumulator 9.

A pressure-equalizing pipe 3 for equalizing the pressures of the refrigerant of the first and second compressors 1*a* and 1*b* and an oil-equalizing pipe 4 for equalizing the quantities of the oil of the first and second compressors 1*a* and 1*b* are each provided to connect the first and second compressors 1*a* and 1*b*.

A conventional method for controlling the conventional outdoor unit of the conventional air conditioner is described hereunder.

FIG. 2 is a flow chart showing the operation of the conventional outdoor unit of the conventional air conditioner.

In the operation of the conventional outdoor unit, when an increase of the total capacity of the outdoor unit is required according to a capacity-increase command while one compressor is being operated and the other compressor is being stopped(S10), the compressor being currently operated is stopped and made to wait for a predetermined time period (S20) to reduce a pressure difference between the compressor being operated and the other compressor being stopped. When it is determined that the predetermined time period has elapsed (S30), the two compressors are started at the same time (S40).

In the conventional outdoor unit operated as described above, when one compressor is intended to be started while the other compressor is being operated, there is a great concern that the compressor will not start due to the large pressure difference between its inlet and outlet sides.

Accordingly, in this case, it is necessary to reduce the pressure difference between the inlet and outlet sides of the compressor intended to start.

As described above, when the total capacity of the air conditioner should be increased while one of two compressors is being operated, the compressor being operated should be stopped before the other compressor is operated. Accordingly, the cooling or heating operation of the air conditioner is stopped for the predetermined time period, so that there occurs a problem that the comfort of a user is decreased by the stoppage of air conditioning.

SUMMARY OF THE INVENTION

Accordingly, the present invention has been made keeping in mind the above problems occurring in the prior art, and an object of the present invention is to provide an air conditioner with a pressure regulation device and method for controlling the same, which is capable of starting one or more additional compressors without hindrance when it is necessary to start the additional compressors according to an increase capacity thereof.

In order to accomplish the above object, the present invention provides an air conditioner with pressure regulation device, the air conditioner controlling the number of operated compressors according to load, comprising: a bypass conduit for guiding gaseous refrigerant from the outlet side of compressor to the inlet side of the compressor; a bypass valve arranged on the bypass conduit for selectively opening and shutting the bypass conduit; and a control unit for controlling the opening and closing of the bypass valve so as to assist of the compressor in stop.

In addition, the present invention provides a method for controlling an air conditioner, the air conditioner being comprised of a bypass conduit for guiding gaseous refrigerant from the outlet side of compressor to the inlet side of the compressor; a bypass valve arranged on the bypass conduit for selectively opening and shutting the bypass conduit; and a control unit for controlling the opening and closing of the bypass valve so as to assist of the compressor in stop, a plurality of compressors operated according to load, a plurality of bypass conduits for guiding gaseous refrigerant from the outlet sides of the compressors to the inlet sides of the compressors, and a pressure regulation unit consisting of a first valve disposed between the inlet side of the compressor and a refrigerant conduit connected to the return side of the indoor unit of the air conditioner, a capillary tube connected in parallel with the first valve and a second valve connected in serial with the capillary tube to be selectively opened and closed, comprising the steps of: opening the bypass valves for one or more compressors to be started, and closing all the valves of the pressure regulation units for one or more compressors to be started; starting the compressors and reducing the pressure difference between the interior and exterior of each of the compressors stage by stage by controlling the opening of the pressure regulation units; and shutting the bypass conduits and normally driving the compressors.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
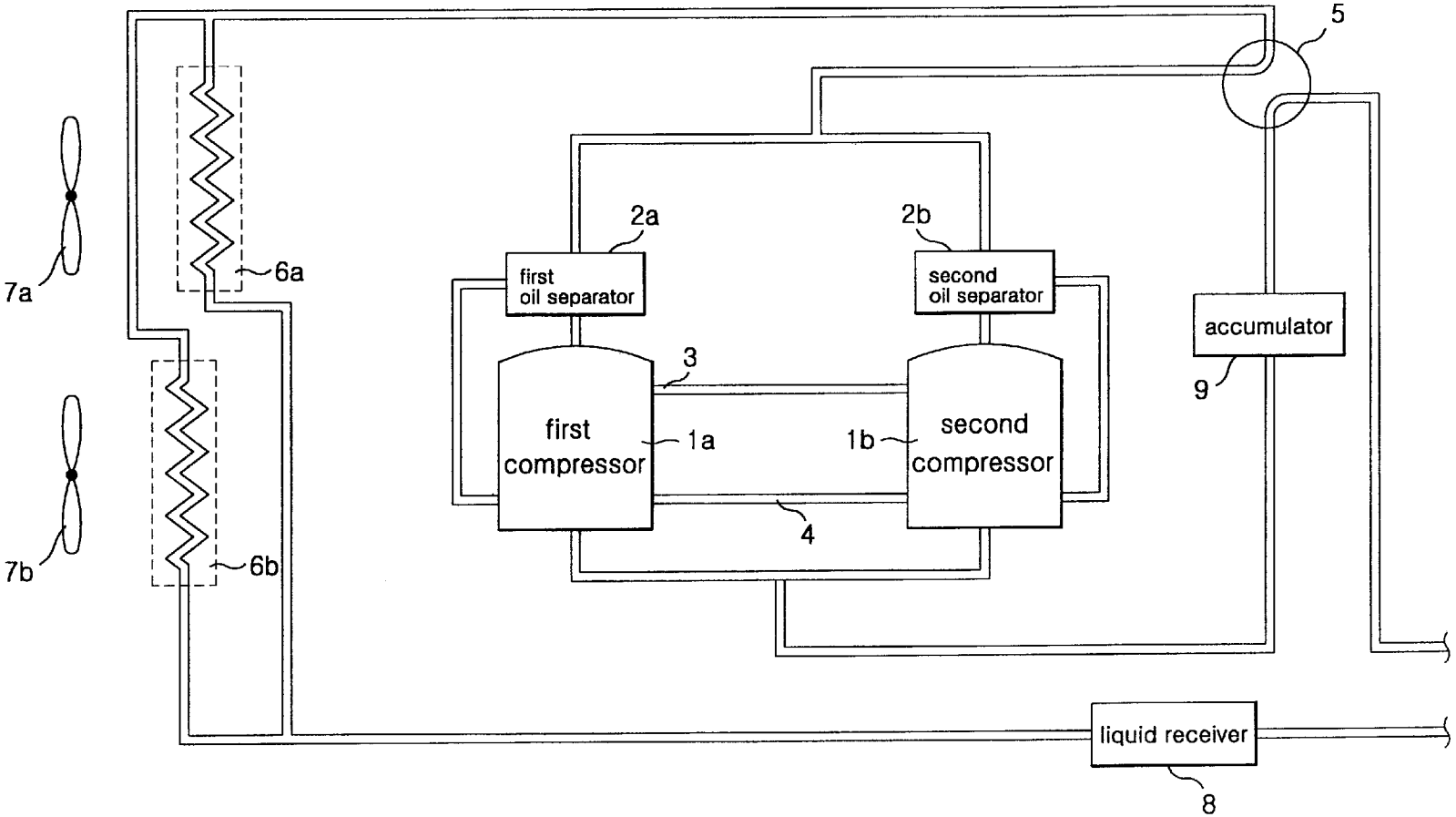
Fig. 1 (PRIOR ART)
FIG. 1 is a schematic diagram showing the construction of the outdoor unit of a conventional air conditioner.
Figure 2:
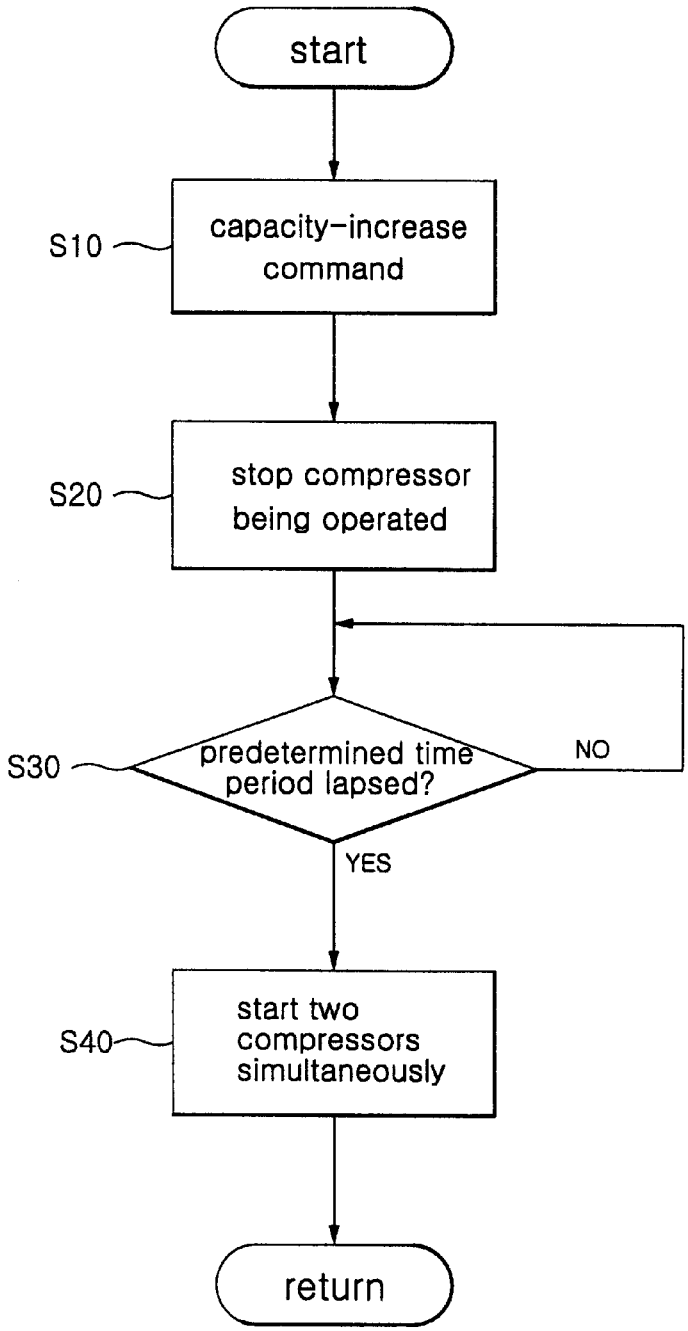
Fig. 2 (PRIOR ART)
FIG. 2 is a flow chart showing the operation of the conventional outdoor unit of the conventional air conditioner.
Figure 3:
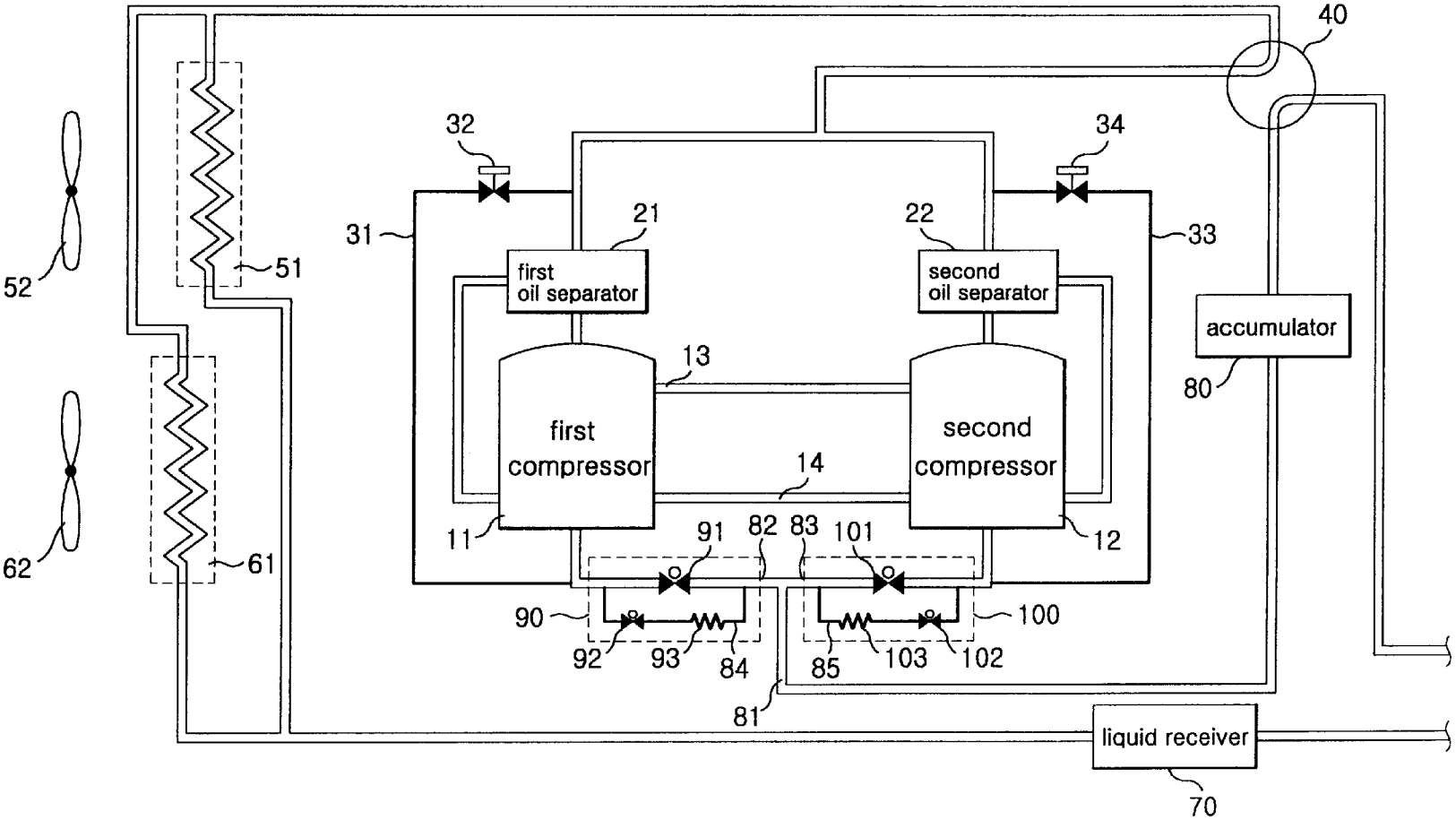
FIG. 3 is a schematic diagram showing the construction of the outdoor unit of an air conditioner with a pressure regulation device in accordance with the present invention.

FIG. 3 is a schematic diagram showing the construction of the outdoor unit of an air conditioner with a pressure regulation device in accordance with the present invention.

With reference to this drawing, the outdoor unit of the present invention includes a plurality of constant-speed compressors. In this embodiment, the constant-speed compressors are comprised of a first compressor 11 and a second compressor 12 that are connected in parallel. An pressure-equalizing pipe 13 for equalizing the pressures of the refrigerant of the first and second compressors 11 and 12 and an oil-equalizing pipe 14 for equalizing the quantities of the oil of the first and second compressors 11 and 12 are each provided to connect the first and second compressors 11 and 12 to each other.

In order to separate oil from refrigerant discharged from the compressors 11 and 12, a first oil separator 21 is connected to the outlet side of the first compressor 11 and a second oil separator 22 is connected to the outlet side of the second compressor 12.

A first bypass conduit 31 is arranged to guide refrigerant from the outlet side of the first oil separator 21 to the inlet side of the first compressor 11, and a first bypass valve 32 is disposed on the first bypass conduit 31 to selectively open and shut the first bypass conduit 31. A second bypass conduit 33 is arranged to guide refrigerant from the outlet side of the second oil separator 22 to the inlet side of the second compressor 12, and a second bypass valve 34 is disposed on the second bypass conduit 33 to selectively open and shut the second bypass conduit 33.

Meanwhile, the outlet sides of the first and second oil separators 21 and 22 are merged together and then connected to first and second condensers 51 and 61 through a four-way valve 40. The condensers 51 and 61 are connected to an indoor unit (not shown) through a liquid receiver 70. A first condenser fan 52 is situated in the vicinity of the first condenser 51 and a second condenser fan 62 is situated in the vicinity of the second condenser 61. The refrigerant return side of the indoor unit is connected to an accumulator 80, and the outlet side conduit 81 of the accumulator 80 is branched into a first refrigerant conduit 82 connected to the inlet side of the first compressor 11 and a second refrigerant conduit 83 connected to the inlet side of the second compressor 12.

A first pressure regulation unit 90 is arranged on the first refrigerant conduit 82, and a second pressure regulation unit 100 is arranged on the second refrigerant conduit 83. The first and second pressure regulation units 90 and 100 serve to regulate the suction pressures of started compressors stage by stage, together with the first and second bypass valves 32 and 34.

Each of the first and second pressure regulation units 90 and 100 includes a first valve 91 or 101 arranged on the first or second refrigerant conduit 82 or 83 connected to the inlet side of the first or second compressor 11 or 12, a capillary tube 93 or 103 connected in parallel with the first valve 91 or 101, and a second valve 92 or 102 connected in serial with the capillary tube 93 or 103 for adjusting the opening of the inlet side of the compressor 11 or 12.

In this case, the capillary tube 93 or 103 and the second valve 92 or 102 directly connected to the capillary tube 93 or 103 can be displaced by a motorized valve the degree of opening of which can be adjusted. The entire pressure regulation unit 90 or 100 can be displaced by a motorized valve, too.

Also, the entire pressure regulation unit 90 or 100 can be displaced by a first valve arranged on the refrigerant conduit connected to the inlet side of the compressor, an additional refrigerant conduit 84 or 85 connected in parallel with the first valve 91 or 101, the diameter of which is smaller than refrigerant conduit, and a second valve 92 or 102 arranged on the additional refrigerant conduit 84 or 85.

Figure 4:
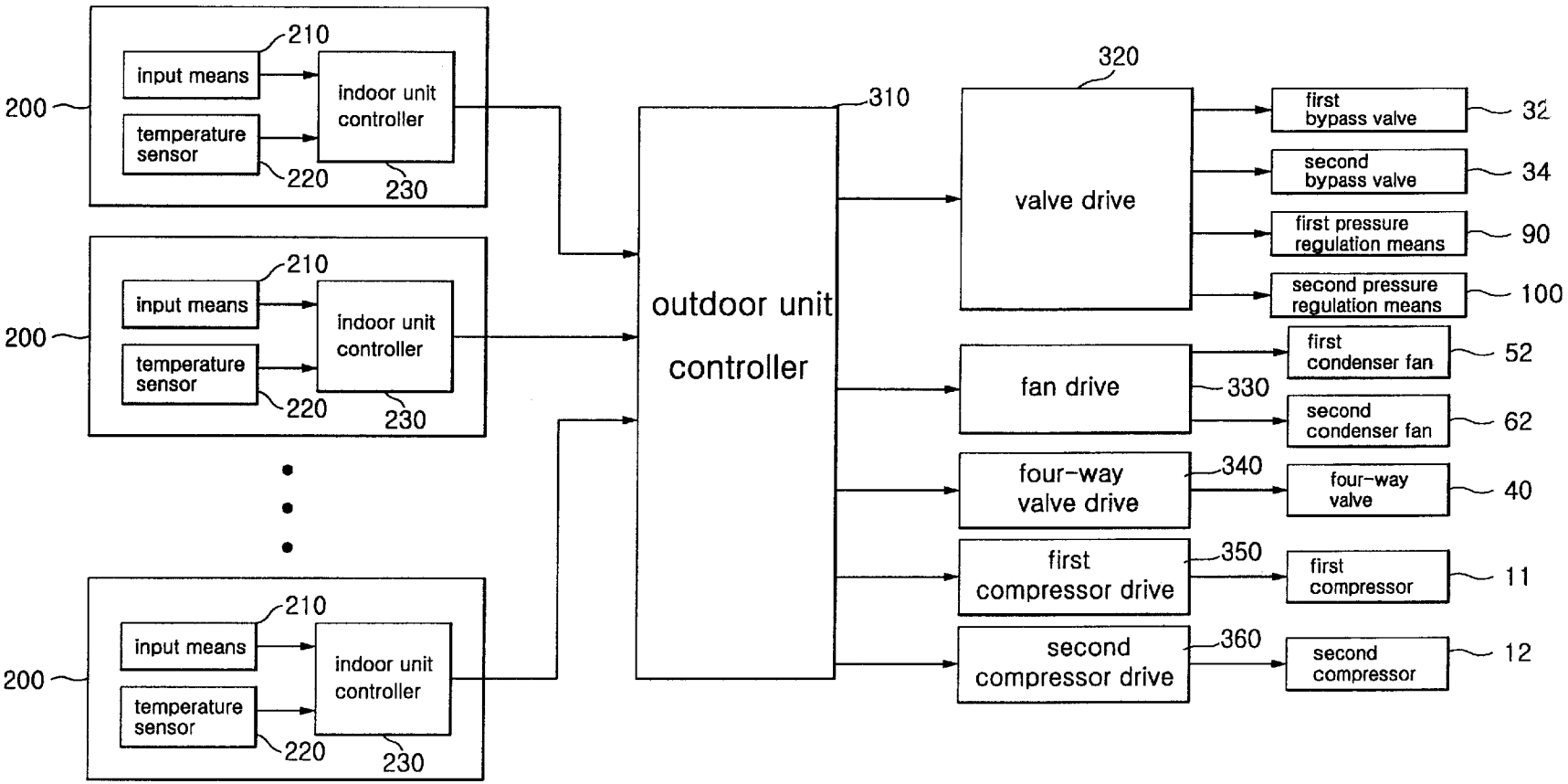
FIG. 4 is a block diagram showing the control of the air conditioner of the present invention.

FIG. 4 is a block diagram showing the control of the air conditioner of the present invention.

With reference to this drawing, the air conditioner of the present invention includes a plurality of indoor units 200. Each of the indoor units 200 includes input means 210 for receiving commands from users, a temperature sensor 220 for sensing indoor temperatures, and an indoor unit controller 230 for transmitting information input through the input means 210 to an outdoor unit controller (will be described). In this case, the input means 210 may include a remote controller.

The air conditioner of the present invention further includes the outdoor unit controller 310 for determining the amount of load using information transmitted from the indoor units 200, a valve drive 320 for regulating the opening of the first and second bypass valves 32 and 34 and the first and second pressure regulation units 90 and 100, a fan drive 330 for driving the first and second condenser fans 52 and 62, a four-way valve drive 340 for switching the fluid passages of the four-way valve 40, and first and second compressor drives 350 and 360 for driving the first and second compressors 11 and 12, respectively.

The air conditioner of the present invention is characterized in that there can be prevented the failure of the start of one or more additional compressors due to the pressure difference between the interior and exterior of the additional compressors while one or more compressors are operated. This will be described in detail with reference to FIG. 5.

Figure 5:
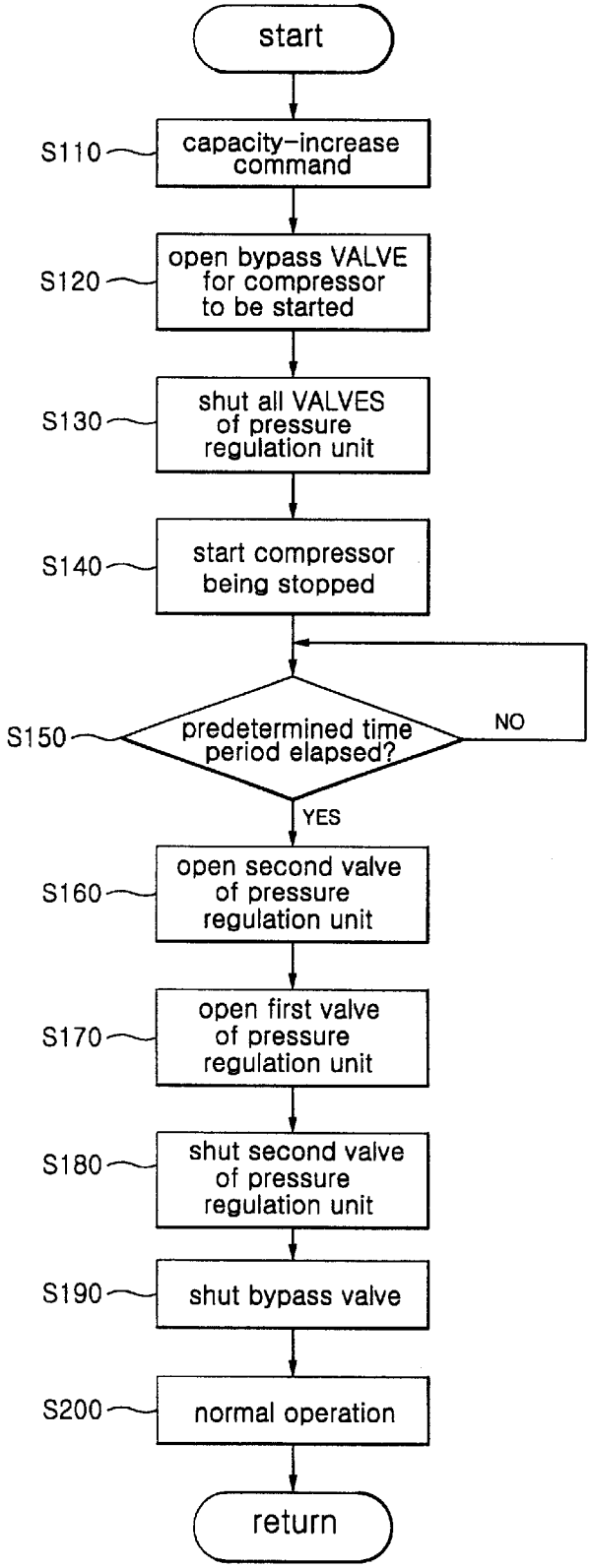
FIG. 5 is a flowchart showing the operation of the air conditioner of the present invention.

FIG. 5 is a flowchart showing the operation of the air conditioner with a pressure regulation device in accordance with the present invention.

With reference to FIG. 5, when a capacity-increase command is input to drive an additional compressor (S110) so as to increase the capacity of the air conditioner, the outdoor controller 310 opens the second bypass valve 34 for the second compressor 12 being currently stopped, by controlling the valve drive 320 (S120). The outdoor controller 310 shuts all the valves of the second pressure regulation unit 100 (S130). As a result, the outlet and inlet sides of the second compressor 12 being stopped are connected to each other through the second bypass conduit 33, so that high-pressure gaseous refrigerant flows from the first compressor 11 to the inlet side of the second compressor 12, thereby first reducing the pressure difference between the interior and exterior of the second compressor 12.

After the second compressor 12 is started, the outdoor unit controller 310 determines if a predetermined time period has elapsed (S150). The predetermined time period, for example, may be three minutes, and is a time period during which the pressure difference between the interior and exterior of the second compressor 12 is decreased sufficiently in order not to hinder the compressor from starting.

If it is determined that the predetermined time period has elapsed in STEP S150, the outdoor unit controller 310 opens the second valve 102 of the second pressure regulation unit 100 (S160). In this case, the pressure in the inlet side of the second compressor 12 is greater than the pressure in the inlet side of the capillary tube 103, so the pressure in the inlet side of the second compressor 12 is transmitted to the inlet side of the capillary tube 103 through the capillary tube 103. Accordingly, the pressure in the inlet side of the second compressor 12 is reduced, while the pressure in the inlet side of the capillary tube 103 is increased.

The outdoor unit controller 310 opens the first valve 101 of the second pressure regulation unit 100 (S170), shuts the second valve 102 of the second pressure regulation unit 100 (S180), and shuts the second bypass valve 34 (S190). Accordingly, the pressure in the inlet side of the second compressor 12 is reduced by one stage and the pressure of gaseous refrigerant returned from the indoor unit is increased by one stage, so both pressures are equalized.

The starting of the second compressor 12 is completed by reducing the pressure difference between the inlet side and outlet side of the second compressor 12 stage by stage. When the starting of the second compressor 12 is completed, the outdoor controller 310 normally drives the second compressor 12 by controlling the second compressor drive 360 (S200).

The above-described procedure can be applied to the case, in which the first compressor 11 is started while the second compressor 12 is operated and the first compressor 11 is stopped.

As described above, the air conditioner with a pressure regulation device and method for controlling the same of the present invention is capable of safely starting one or more additional compressors without stopping one or more compressors in operation when the former compressors are started during the operation of the latter compressors, thereby maintaining comfortable air conditioning without stoppage.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner having a plurality of compressors, the number of operated compressors controlled according to load, said air conditioner comprising:

a bypass conduit for guiding gaseous refrigerant from the outlet side of a compressor to the inlet side of the compressor;

a bypass valve arranged on said bypass conduit for selectively opening and shutting said bypass conduit;

a control unit for controlling the opening and closing of said bypass valve so as to assist of the compressor in stopping; and a pressure regulation unit adapted to regulate the pressure in the inlet side of a first compressor, which is to be started, during the starting of the first compressor stage by stage, said pressure regulation unit comprising a motorized valve that controls direct inlet flow to the first compressor and does not control inlet flow to any other compressor.

2. An air conditioner having a plurality of compressors, the number of operated compressors controlled according to load, said air conditioner comprising:

a bypass conduit for guiding a gaseous refrigerant from the outlet side of a compressor to the inlet side of the compressor;

a bypass valve arranged on said bypass conduit for selectively opening and shutting said bypass conduit;

a control unit for controlling the opening and closing of said bypass valve so as to assist of the compressor in stopping; and a pressure regulation unit adapted to regulate the pressure in the inlet side of a first compressor, which is to be started, during the starting of the first compressor stage by stage, said pressure regulation unit comprising:

a first valve arranged on the refrigerant conduit connected to the inlet side of the first compressor, an additional refrigerant conduit connected in parallel with said first valve and having its diameter smaller than that of said refrigerant conduit, and a second valve arranged on said additional refrigerant conduit.

3. The air conditioner of claim 2, further comprising a capillary tube connected in parallel with said first valve, and connected in series with said second valve.

4. A method for controlling an air conditioner, said air conditioner being comprised of a plurality of compressors operated according to load, a bypass conduit for guiding gaseous refrigerant from the outlet side of compressor to the inlet side of the compressor; a bypass valve arranged on said bypass conduit for selectively opening and shutting said bypass conduit; and a control unit for controlling the opening and closing of said bypass valve so as to assist the compressor in stop, and a plurality of pressure regulation units each consisting of a first valve disposed between the inlet sides of the compressors and a refrigerant conduit connected to the return side of the indoor unit of the air conditioner, a capillary tube connected in parallel with the first valve and a second valve connected in serial with the capillary tube to be selectively opened and closed, comprising the steps of:

(1) opening the bypass valve for the compressor to be started, and closing all the valves of the pressure regulation unit for the compressor to be started;

(2) starting said compressor;

(3) reducing the pressure difference between the inlet side and outlet side of said compressor stage by stage by controlling the opening of said pressure regulation unit; and (4) shutting said bypass conduit and normally driving said compressor.

5. The method of claim 4, wherein said step of reducing the pressure is performed after the starting of said compressor and the elapse of a predetermined time period.

6. The method of claim 4, wherein said step of reducing the pressure difference is performed by sequentially conducting the opening of a second valve, the opening of a first valve, and the shutting of the second valve.

7. An air conditioner comprising a plurality of compressors each having an inlet side and an outlet side, each compressor of said plurality of compressors having:

a bypass conduit for guiding a gaseous refrigerant from the outlet side said compressor to the respective inlet side of said compressor;

a bypass valve arranged on said bypass conduit for selectively opening and shutting said bypass conduit;

a control unit for controlling the opening and closing of said bypass valve to assist the compressor to stop; and a pressure regulation unit comprising:

a first valve disposed between the inlet sides of the compressor and a refrigerant conduit connected to the return side of the indoor unit of the air conditioner;

a capillary tube connected in parallel with the first valve; and a second valve connected in serial with the capillary tube to be selectively opened and closed;

said air conditioner further comprising:

a means for opening the bypass valve for a first compressor to be started;

a means for closing all the valves of the pressure regulation unit for said first compressor;

a means for starting said first compressor;

a control means for controlling the opening of said pressure regulation unit of said first compressor to reduce a pressure difference between the inlet side and outlet side of said first compressor; and a means for shutting said bypass conduit to normally drive said first compressor.

8. The air conditioner of claim 7, wherein said control means is adapted to reduce pressure after the starting of said first compressor and the elapse of a predetermined time period.

9. The air conditioner of claim 7, wherein said control means is adapted to reduce the pressure difference by sequentially opening a second valve, opening a first valve, and shutting the second valve.

10. An air conditioner comprising a plurality of compressors and a pressure regulation device, said air conditioner having a cooling capacity, said plurality of compressors including at least one first compressor that is in operation at a time and at least one second compressor that is not in operation at said time, said pressure regulation device comprising a means for safely starting said at least one second compressor to increase said cooling capacity without stopping said at least one first compressor which is in operation.

* * * * *